United States Patent [19]

Shimada et al.

[11] 4,250,240

[45] Feb. 10, 1981

[54] PHOTOSENSITIVE MATERIAL FOR USE IN ELECTROPHOTOGRAPHY

[75] Inventors: Masaru Shimada, Numazu; Shoji Maruyama, Yokohama; Hiroshi Tamura, Fujisawa, all of Japan

[73] Assignee: Ricoh Company, Ltd., Tokyo, Japan

[21] Appl. No.: 50,096

[22] Filed: Jun. 19, 1979

[30] Foreign Application Priority Data

Jun. 21, 1978 [JP] Japan ..... 53-74280

[51] Int. Cl.[3] ..... G03G 5/04

[52] U.S. Cl. ..... 430/66; 430/961

[58] Field of Search ..... 430/66, 67, 58, 961

[56] References Cited

U.S. PATENT DOCUMENTS

| | | | |
|---|---|---|---|
| 3,312,547 | 4/1967 | Levy | 430/66 |
| 3,775,115 | 11/1973 | Sorkin et al. | 430/66 |
| 4,148,637 | 4/1979 | Kubota et al. | 430/66 |

FOREIGN PATENT DOCUMENTS

| | | |
|---|---|---|
| 50-96229 | 7/1975 | Japan . |
| 53-23636 | 3/1978 | Japan . |

*Primary Examiner*—Richard L. Schilling

[57] ABSTRACT

The present invention relates to a photosensitive material for use in electrophotography comprising a photoconductive layer on which there is a transparent protective layer consisting essentially of a substance resulting from partial hydrolysis of a mixture of (a) a compound having the following general formula I, (b) a copolymer of a compound having the general formula II with a compound having the general formula III or maleic anhydride and (c) a compound having the general formula IV, (1) General formula I $$(R^1)_l Si(OR^2)_m$$

[wherein $R^1$ is a $C_{1-4}$ alkyl radical, vinyl radical, γ-methacryloxypropyl radical, phenyl radical, γ-glycidoxypropyl radical, γ-chloropropyl radical, γ-mercaptopropyl radical, γ-β(aminoethyl)γ-aminopropyl radical or γ-aminopropyl radical; $R^2$ is a hydroxyethylalkyl ether radical or $C_{1-4}$ alkyl radical; l is 0–2; and m is 2–4.]

(2) General formula II

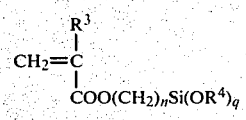

[wherein $R^3$ is hydrogen or a methyl radical; $R^4$ is hydrogen or a $C_{1-4}$ alkyl radical; n is 1–4; and q is 1–3.]

(3) General formula III

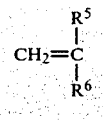

[wherein $R^5$ is hydrogen or a methyl radical; $R^6$ is —$COOR^7$ ($R^7$ is hydrogen or a $C_{1-12}$ alkyl radical, hydroxyalkyl radical, glycidyl radical or dimethylaminoalkyl radical), —CN, —$OCOCH_3$, —$CONH_2$,

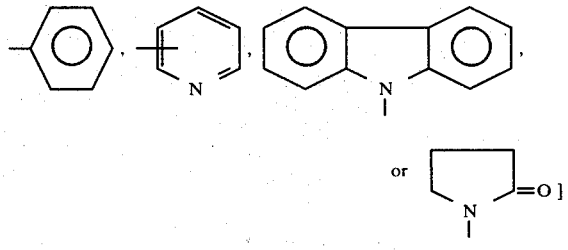

(4) General formula IV

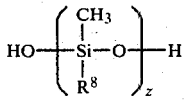

[wherein $R^8$ is a $C_{1-4}$ alkyl radical or phenyl radical; z is 2–25.]

5 Claims, No Drawings

PHOTOSENSITIVE MATERIAL FOR USE IN ELECTROPHOTOGRAPHY

BACKGROUND OF THE INVENTION (a) Field of the Invention

The present invention relates to a photosensitive material for use in electrophotography, in particular a photosensitive material comprising a photoconductive layer on which there is a protective layer consisting essentially of a substance resulting from partial hydrolysis of a composition (mixture) of (a) a silane coupling agent, (b) an acryl resin having a silane radical copolymerized with styrene, acrylic acid, maleic acid, etc., and (c) a diorganopolysiloxane with terminal hydroxyl radicals at both ends of the molecular chain.

(b) Description of the Prior Art

Electrophotographic photosensitive materials comprising a conductive substrate on which there is a photoconductive layer of an inorganic or organic semi-conductor are well known. And, the so-called Carlson process is employed therein for the purpose of forming an electrostatic latent image thereon, said process comprising electrifying the surface of the photoconductive layer and then subjecting the thus electrified material to an imagewise exposure. However, these photosensitive materials have been defective in that the photoconductive layer, being exposed, is deteriorated in mechanical strength and consequently is very often destroyed by repeated use.

For this reason, various photosensitive materials have been proposed to improve the durability of conventional materials by further providing a transparent protective layer on the photoconductive layer. And the materials used for the formation of said protective layer such as polyethylene, poly-n-butylmethacrylate, polyamide, polyester, polyurethane, polycarbonate, polyvinyl formal, polyvinyl acetal, polyvinyl butyral, ethyl cellulose, cellulose acetate, polyethylene terephthalate, polyethylene terephthalate-polyethylene isophthalate copolymer, etc. are well known. These materials surely have some merit in protecting the photoconductive layer, but are defective in that they are not always sufficient in their durability and are liable to hamper the formation of stable images under the influence of humidity and changes in humidity.

In addition, Japanese Laid-open Patent Applications No. 96229/1975 and No. 23636/1978 disclose photosensitive materials wherein a certain kind of silicon compound has been incorporated in the protective layer in a fixed quantity to improve its durability. These photosensitive materials are surely superior in the properties such as hardness, abrasion resistance, etc., but are somewhat inferior in their adhesive property. The fact is that in particular when the photoconductive layer comprises a metal such as Se, Se-Te or the like or a metal sulfide such as CdS, the adhesion between the protective layer and the photoconductive layer is liable to become so insufficient that a photosensitive material of a desired degree of durability is not obtainable.

SUMMARY OF THE INVENTION

One object of the present invention is to overcome the foregoing defects and to provide an electrophotographic photosensitive material having a protective layer on its surface which is superior especially in durability and moisture resistance and so capable of constantly forming stable images.

Another object of the present invention is to provide an electrophotographic photosensitive material which may be manufactured without resort to complicated processes and operated in a known manner.

The present inventors have discovered that a substance resulting from partial hydrolysis of a mixture of some specific substances can be applied with extreme effectiveness for the purpose of forming a transparent protective layer of the photosensitive material. The present invention has been completed on the basis of this discovery.

In other words, the photosensitive material according to the present invention is characterized by comprising a photoconductive layer on which there is a transparent protective layer consisting essentially of a substance resulting from partial hydrolysis of a mixture of (a) a compound having the following general formula I, (b) a copolymer of a compound having the following general formula II with a compound having the general formula III or maleic anhydride and (c) a compound having the following general formula IV, (1) General formula I $$(R^1)_l Si(OR^2)_m$$

[wherein $R^1$ is a $C_{1-4}$ alkyl radical, vinyl radical, γ-methacryloxypropyl radical, phenyl radical, γ-glycidoxypropyl radical, γ-chloropropyl radical, γ-mercaptopropyl radical, γ-β(aminoethyl)γ-aminopropyl radical or γ-aminopropyl radical; $R^2$ is a hydroxyethylalkyl ether radical or $C_{1-4}$ alkyl radical; l is 0–2; and m is 2–4.]

(2) General formula II

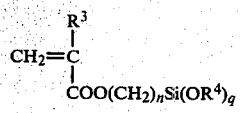

[wherein $R^3$ is hydrogen or a methyl radical; $R^4$ is hydrogen or a $C_{1-4}$ alkyl radical; n is 1–4; and q is 1–3.]

(3) General formula III

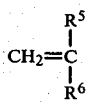

[wherein $R^5$ is hydrogen or a methyl radical; $R^6$ is —$COOR^7$ ($R^7$ is hydrogen or a $C_{1-12}$ alkyl radical, hydroxyalkyl radical, glycidyl radical or dimethylaminoalkyl radical), —CN, —$OCOCH_3$, —$CONH_2$,

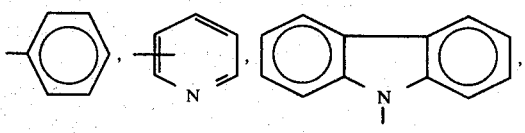

-continued or 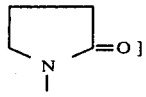

(4) General formula IV

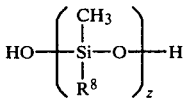

[wherein $R^8$ is a $C_{1-4}$ alkyl radical or phenyl radical; z is 2–25.]

DETAILED DESCRIPTION OF THE PREFERRED EMBODIMENTS OF THE INVENTION

The protective layer of the photosensitive material according to the present invention, as described above, incorporates therein a substance resulting from partial hydrolysis of a mixture of (a) a silane coupling agent having the general formula I, (b) a copolymer of a compound having the general formula II with a compound having the general formula III or maleic anhydride, for instance, such as an acryl resin having a silane radical copolymerized with styrene, acrylic acid, maleic acid, etc., and (c) a diorganopolysiloxane with terminal hydroxyl radicals at both ends of the molecular chain having the general formula IV.

In this instance, the compound having the general formula I (Component A) includes, for instance, methyltrimethoxy silane, vinyltriethoxy silane, dimethyldimethoxy silane, diphenyldimethoxy silane, phenylmethyldiethoxy silane, phenyltrimethoxy silane, vinyltris (β-methoxyethoxy) silane, γ-glycidoxypropyltrimethoxy silane, γ-methacryloxypropyltrimethoxy silane, N-β(aminoethyl) γ-aminopropyltrimethoxy silane, N-β(aminoethyl)γ-aminopropylmethyldimethoxy silane, γ-chloropropyltrimethoxy silane, γ-aminopropyltriethoxy silane, γ-mercaptopropyltrimethoxy silane, tetraethoxy silane, tetrabutoxy silane, etc. In particular, methyltrimethoxy silane, vinyltriethoxy silane, γ-methacryloxypropyltrimethoxy silane, tetraethoxy silane, vinyltrihydroxyethylmethylether silane are used effectively. And these compounds may be used singly or in a suitable combination of two kinds or more of them.

The copolymer of a compound having the general formula II with a compound having the general formula III (inclusive of maleic anhydride) (Component B) includes, for instance, copolymers of styrene, maleic anhydride, acrylate such as methyl methacrylate, butylmethacrylate, ethylacrylate or butylacrylate, acryl amide, glycidyl methacrylate, hydroxyethylmethacrylate, acrylonitrile, isoprene, vinyl acetate, vinyl pyrrolidone, vinyl pyridine, vinyl carbazole, etc. with γ-methacryloxypropyltrimethoxy silane. In particular, the copolymer of methyl methacrylate, acrylate such as methyl acrylate or butyl acrylate, glycidyl methacrylate or acrylic acid with γ-methacryloxpropyltrimethoxy silane and the copolymer of styrene or maleic anhydride with γ-methacryloxypropyltrimethoxy silane can be used with effective results.

These copolymers may be used in a suitable combination of two kinds or more of them, wherein the copolymerization ratio, inclusive of the monomer specified in the general formula II, is not limited.

And, the compound having the general formula IV (Component C) includes, for instance, a dimethylpolysiloxane with terminal hydroxyl radicals at both ends of the molecular chain, a methylphenylpolysiloxane with terminal hydroxyl radicals at both ends of the molecular chain, etc. The polymerization degree z of these substances suitably should be in the range of from 2 to 25, preferably 2 to 10 (integer), and they may be used singly or in a suitable combination of two kinds or more of them.

In the present invention, as aforesaid, a substance is utilized for the transparent protective layer which is obtained from partial hydrolysis of the mixture of substances of three kinds (Component A: Component B: Component C=70–98.9:1–20:0.1–10, % by weight). In this instance, if these three kinds of components are utilized separately, it will result in a number of drawbacks, whereby the objects of the present invention shall never be achieved.

In more detail, for instance, a substance resulting from partial hydrolysis of the silane coupling agent alone is superior in hardness and abrasion resistance, but is so inferior in adhesive property that especially when the photoconductive layer comprises Se, Se-Te, CdS or the like, it scarcely adheres and consequently peels off. Additionally, since this substance is devoid of a film property when the electrophotographic photosensitive material uses it there occurs cracking so that the durability is deteriorated even after production of several hundreds of copies. Furthermore, the electrophotographic photosensitive material using the acryl resin having a silane radical and its copolymer alone is liable to cracks and is inferior in durability because the aforegoing substances are extremely superior in adhesive property but inferior in hardness. Still further, the single use of the diorganopolysiloxane with terminal hydroxyl radicals at both ends of the molecular chain is impossible because it possesses no film property.

The practical preparation of the photosensitive material according to the present invention is completed by providing a photoconductive layer onto a conductive substrate and applying a protective layer-forming solution thereon and drying.

As the conductive substrate there can be used a metal plate or cylinder of aluminum, copper, stainless steel or the like, a paper, plastic film, glass plate, cloth or the like subjected to electroconductive treatment such as metal evaporation or the like.

Further, as the photoconductor for use in the photoconductive layer there can be enumerated inorganic semi-conductors such as selenium, zinc oxide, titanium oxide, cadmium sulfide, etc., and film-forming organic semi-conductors such as poly-N-vinyl carbazole, poly-N-vinyl-3,6-dibromocarbazole, pyrene-formaldehyde resin, polyvinyldibenzothiophene, polyvinylanthracene, etc. In the use of said inorganic semi-conductors it is to be noted that therein are included those such as Se which can be used solely as well as such as CdS and ZnO which are to be used together with a resin binder. As such resins are applicable, for instance, acryl resin, silicone resin, alkyd resin, epoxy resin, styrene-butadiene resin and melamine resin.

Still further, sensitizers may be incorporated in the photosensitive layer. For instance, when the photosensitive layer is made of ZnO there may be added Rose bengal, fluorescein and so forth, when it is made of an organic semi-conductor there may added coloring matters such as methylene blue, benzopyrylium and so forth or electron acceptor such as 2,4,-7-trinitrofluorenone or the like and when the photosensitive layer is made of Se it may be doped with Te.

Onto this photoconductive layer is formed the transparent protective layer comprising the substance resulting from partial hydrolysis of the mixture (composition) of three kinds of components as aforesaid. At this time, hydrochloric acid, sulfuric acid, acetic acid, etc. may be added in order to accelerate said hydrolysis reaction. This reaction product is also preferred to be used dissolved in a solvent such as alcohol, toluene or the like, and further a catalyst may be added thereto in order to accelerate the hardness. The catalysts suitably used for that purpose include alkali metal salts of inorganic acid or organic acid, for instance, such as sodium nitrite, sodium sulfate, sodium acetate, manganese naphthenate, cobalt naphthenate, etc.

The layer-forming operation using this composition can be achieved by spray coating, roll coating, immersion coating, wire bar coating and the like. This coating can be cured at a temperature ranging from room temperature to 50° C. within 1 hour with no necessity of drying at a temperature more than 100° C. for curing as in other silane coupling agents. This feature is extremely serviceable for the purpose of preventing the crystallization required in the cases of non-crystalline selenium and the like.

In order to improve the sensitivity of the photosensitive material, furthermore, this protective layer may be admixed, in suitable quantities, with spectrum sensitizers, for instance, such as Rhodamine B, Rhodamine B Extra, Rhodamine 6G, Crystal Violet, Methylene Blue, Fuchsine, Brilliant Green, Victoria blue, Eosine S, Erythrosine, Rose bengale, fluorescein, pinocyanol, etc., chemical sensitizers, for instance, such as anthraquinone, 1-nitroanthraquinone, tetracyanoethylene, tetracyanoquinodimethane, phthalic anhydride, maleic anhydride, picric acid, Lewis acid, etc.

The aforesaid protective layer may be formed, directly or through a layer of adhesives, for instance, such as G-103 (produced by Konishi K. K.), on the photoconductive layer, or may be formed, in admixture with adhesives, thereon so as to have a thickness of 0.1–20 μm. When the thickness of the protective layer is less than 0.1 μm, it is inferior in durability, and contrarily when said thickness is more than 20 μm, it is excessively electrified to thereby cause stains throughout the image area. Therefore, it may be undesirable that the thickness of the protective layer deviates from aforesaid range.

As the electrophotographic processes applicable to the thus prepared photosensitive material there can be enumerated, in addition to Carlson method, polarity inversion method comprising the processes of electrification simultaneous with overall exposure—inverse polarity electrification—imagewise exposure—development (which see Japanese published examined patent application No. 2965/1973), KIP method comprising the processes of electrification—imagewise exposure simultaneous with inverse polarity electrification or imagewise exposure simultaneous with AC electrification—overall exposure—development (which see Japanese published examined patent application No. 2627/1968), NP method comprising the processes of electrification—AC corona discharge simultaneous with imagewise exposure—overall exposure—development (which see English Pat. No. 1165405) and so forth. However, when the photosensitive material of the present invention is applied to these electrophotographic processes except the Carlson method, it is preferable that the protective layer should have a thickness of from 5 to 20 μm because the transparent protective layer desirably should be electrified as much as possible.

The transparent protective layer of the photosensitive material according to the present invention is thus superior especially in durability and so is not attacked by solvents such as acetone and kerosine, thereby being capable of producing copies of the stable image independently of changes in humidity and temperature. As a matter of course, there is no fear of the electrophotographic characteristics of the photoconductive layer being deteriorated by the provision of the protective layer.

Some synthesis examples of Component B (copolymer of a compound having the general formula II with a compound having the general formula III (inclusive of maleic anhydride)) will be given below. The term "part" used herein is by weight.

SYNTHESIS EXAMPLE 1

Two parts of benzoyl peroxide was dissolved in a mixture of 200 parts of methyl methacrylate, 50 parts of butyl acrylate, 45 parts of glycidyl methacrylate, 5 parts of acrylic acid and 200 parts of γ-methacryloxypropyltrimethoxy silane. The same was added to 1500 parts of toluene heated to a temperature of 80° to 85° C. with stirring for two hours. The viscosity was raised gradually, showing the progress of the reaction. This reaction was completed by effecting additional five hours' stirring at the same temperature.

SYNTHESIS EXAMPLE 2

Two parts of benzoyl peroxide was dissolved in a mixture of 300 parts of styrene, 150 parts of maleic anhydride and 50 parts of γ-methacryloxypropyltrimethoxy silane. The same was added to 1500 parts of toluene heated to a temperature of 80° to 85° C. with stirring for three hours. This reaction was completed by effecting additional five hours' stirring at the same temperature. The resulting white deposit was taken out by filtration and dried.

SYNTHESIS EXAMPLE 3

Three parts of benzoyl peroxide was dissolved in a mixture of 250 parts of vinyl acetate, 150 parts of butyl acrylate and 100 parts of γ-methacryloxypropyltrimethoxy silane. The same was added to a mixture of 1000 parts of toluene and 500 parts of isopropyl alcohol heated to about 80° C. with stirring for three hours. This reaction was completed by effecting additional eight hours' stirring at the same temperature.

EXAMPLES

The term "part" described hereinafter is by weight.

EXAMPLE 1

Hydrolysis was effected by adding 250 parts of 1% sulfuric acid to a mixture of 2500 parts of methyltrimethoxy silane, 250 parts of ethyl silicate, 750 parts of the copolymer of Synthetic Example 1 (toluene solution, solid content: 25%) and 50 parts of the dimethylpolysiloxane with terminal hydroxyl radicals at both ends of the molecular chain (a mixture wherein z is 2–5). The resulting coating liquid, after eight hours' ageing, was applied, by dipping method, onto a photoconductive layer formed by evaporation-depositing selenium on an aluminum substrate to a thickness of about 50 μm, and the same was dried at 50° C. for one hour to thereby form a transparent protective layer having a thickness of 1.5 μm. The surface of this protective layer was recognized to be glossy and exceedingly superior in smoothness.

The cycle of electrification-exposure-development-transfer was repeated with the thus obtained photosensitive material by means of a conventional image transfer type copying machine, whereby there were obtained copies of clear-cut images likewise in both cases of 20° C., 20% RH and 30° C., 90% RH. And, even after repeated reproduction of 50,000 copies there were observed no changes in the clearness of image, and scarcely occurred wear of the protective layer.

COMPARATIVE EXAMPLE 1

Hydrolysis was effected by adding 250 parts of 1% sulfuric acid to a mixture of 2500 parts of methyltrimethoxy silane and 250 parts of ethyl silicate. The resulting coating liquid, after eight hours' ageing, was applied onto the same photoconductive layer as in Example 1, and the same was dried at 50° C. for one hour to thereby form a protective layer having a thickness of about 1.5 μm. The surface of this protective layer was lusterless, and several cracks were observed thereon.

The cycle of electrification-exposure-development-transfer was repeated with the thus obtained photosensitive material by means of a conventional image transfer type copying machine. As a result, exfoliation of the protective layer began to occur on obtaining the 500th copy, and 90% or more of the protective layer exfoliated on obtaining the 800th copy.

COMPARATIVE EXAMPLE 2

Hydrolysis was effected by adding 300 parts of 1% sulfuric acid to a mixture of 2000 parts of methyltrimethoxy silane, 500 parts of γ-glycidoxypropyltrimethoxy silane, and 250 parts of ethyl silicate. The resulting coating liquid, after eight hours' ageing, was applied onto the same photoconductive layer as in Example 1, and the same was dried at 40° C. for three hours to thereby form a protective layer having a thickness of about 20 μm. The surface of this protective layer was lusterless, and numeral air bubbles were observed therein.

The thus obtained photosensitive material was subjected to the same test procedure as in Example 1, whereby exfoliation of the protective layer began to occur on obtaining the 1200th copy, and 90% or more of the protective layer exfoliated on obtaining the 2300th copy.

EXAMPLE 2

Hydrolysis was effected by adding 300 parts of 1% sulfuric acid to a mixture having the following composition.

| | |
|---|---|
| methyltrimethoxy silane | 1700 parts |
| vinyltriethoxy silane | 800 parts |
| ethyl silicate | 250 parts |
| copolymer of Synthetic Example-2 | 210 parts |
| methylethyl ketone | 500 parts |
| dimethylpolysiloxane with terminal hydroxyl radicals at both ends of the molecular chain | 20 parts |

After eight hours' ageing of the resulting coating liquid, 500 parts of polyurethane resin (TAKENATE M-402, manufactured by Takeda Yakuhin Kogyo K. K.) and 10 parts of Rhodamine B were dissolved therein. Then, it was applied onto the same photoconductive layer as in Example 1 by means of dipping method, and was dried at 40° C. for three hours to thereby form a protective layer having a thickness of about 2 μm. The surface of this protective layer was recognized to be glossy and exceeding superior in smoothness.

The thus obtained photosensitive layer was subjected to the same test procedure as in Example 1, whereby there were obtained copies of clear-cut image even after repeated reproduction of 60000 copies and there scarcely occurred wear of the protective layer.

EXAMPLE 3

A coating liquid was prepared by dissolving 200 parts of nitrile rubber (Bond G-103, manufactured by Konishi K. K.) in 4000 parts of methylethyl ketone. This coating liquid was applied onto the same photoconductive layer as in Example 1 by means of dipping method, and was dried at room temperature to thereby form an about 0.3 μm-thick film so as to be used as an adhesive layer.

On the other hand, hydrolysis was effected by adding 250 parts of 2% sulfuric acid to a mixture of 2000 parts of methyltrimethoxy silane, 500 parts of phenyltriethoxy silane, 300 parts of ethyl silicate, 50 parts of dimethylpolysiloxane with terminal hydroxyl radicals at both ends of the molecular chain (a mixture wherein z=2–10) and 500 parts of the copolymer of Synthetic Example 3, and the same was subjected to eight hours' ageing to form a protective layer-forming liquid.

Subsequently, this protective layer-forming liquid was applied onto said adhesive layer by means of dipping method, and dried at 40° C. for three hours to thereby form an about 2 μm-thick protective layer. The surface of this protective layer was recognized to be glossy and exceedingly superior in smoothness.

The thus obtained photosensitive material was subjected to the same test procedure as in Example 1, whereby there were obtained copies of clear-cut image even after repeated reproduction of 80,000 copies and there scarcely occurred wear of the protective layer.

EXAMPLE 4

A photosensitive material was prepared by applying a solution having the following composition onto an aluminum foil-laminated polyester film, and drying.

| | |
|---|---|
| poly-N-vinylcarbazole | 5 parts |
| 2,4,7-trinitrofluorenone | 7 parts |
| polycarbonate | 1 part |
| epoxy resin | 2 parts |
| tetrahydrofuran | 120 parts |

On the other hand, hydrolysis was effected by adding 5 parts of 1% sulfuric acid to a mixture of 41 parts of methyltrimethoxy silane, 22 parts of γ-β(aminoethyl)γ-aminopropyltrimethoxy silane, 5 parts of ethyl silicate, 1 part of dimethylpolysiloxane with terminal hydroxyl radicals at both ends of the molecular chain (a mixture wherein z is 2–10), 10 parts of the copolymer of Synthetic Example 1 and 50 parts of isopropyl alcohol, and the same was subjected to eight hours' ageing to form a protective layer-forming liquid.

Subsequently, the protective layer-forming liquid was applied onto said photosensitive material by means of spray method, and dried at 50° C. for three hours to thereby form a protective layer having a thickness of about 1.5 μm.

The sensitivity of the thus obtained photosensitive material according to the present invention was 4.5 lux·sec. Even after repeated reproduction of 45,000 copies there occurred neither deterioration in sensitivity nor disorder in image. In contrast, in the photosensitive material lacking a protective layer there occurred stains and disorder in image on the 3000th copy.

TABLE 1

| | Adhesive*1 property | Lead pencil hardness*2 (Scratch resistance) |
|---|---|---|
| Example 1 | 0 | 5H |
| Example 2 | Δ | 5H |
| Example 3 | Δ | 5H |
| Example 4 | 0 | 4H |
| Comparative Example 1 | x | 3H |
| Comparative Example 2 | x | 4H |
| Polyester*3 | Δ | B |
| Nitro cellulose*4 | 0 | HB |
| Poly-urethane*5 | 0 | B |
| Acryl resin*6 | 0 | B |
| Poly-carbonate*7 | 0 | HB |

*1This property was decided according to the degree of exfoliation of a coated film occurring when rapidly peeling a Scotch tape adhered to the coated film in the direction of 180°: 0 - no exfoliation of coated film, Δ - partial exfoliation of coated film and x - complete exfoliation of coated film.

*2This property was decided according to JIS K-5400 "Lead Pencil Scratch Test" and under the load of 150 g.

*3is VYLON200 (manufactured by TOYOBOSEKI K.K.),

*4is JADLAC MT (manufactured by JARD K.K.),

*5is Paraplene Pellet 27SM (manufactured by Nihon Polyurethane Company),

*6is DIANAL BR-88 (manufactured by MITSUBISHI RAYON K.K.) and

*7is PANLITE (manufactured by TEIJIN K.K.). These resins are all available commercially.

What is claimed is:

1. A photosensitive material for use in electrophotography which comprises an electroconductive substrate, a photoconductive layer coated on said electroconductive substrate and a transparent protective layer coated on said photoconductive layer, said transparent protective layer consisting essentially of a material obtained by partial hydrolysis of a mixture of (a) from 70 to 98.9% by weight of one or a mixture of two or more compounds having the formula $$(R^1)_l Si(OR^2)_m$$

wherein $R^1$ is $C_{1-4}$ alkyl, vinyl, γ-methacryloxypropyl, phenyl, γ-glycidoxypropyl, γ-chloropropyl, γ-mercaptopropyl, γ-β(aminoethyl)γ-aminopropyl or γ-aminopropyl; $R^2$ is a hydroxyethylalkyl ether or $C_{1-4}$ alkyl; l is 0 to 2; m is 2 to 4, (b) from 1 to 20% by weight of one or a mixture of two or more copolymers of first monomer having the formula

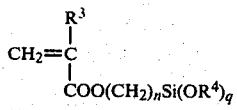

wherein $R^3$ is hydrogen or methyl; $R^4$ is hydrogen or $C_{1-4}$ alkyl; n is 1 to 4; and q is 1 to 3, with second monomer selected from the group consisting of maleic anhydride and monomer having the formula

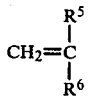

wherein $R^5$ is hydrogen or methyl; $R^6$ is —$COOR^7$, —CN, —$OCOCH_3$, —$CONH_2$,

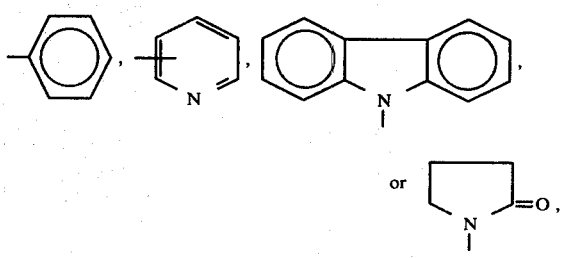

and wherein $R^7$ is hydrogen or $C_{1-12}$ alkyl, hydroxyalkyl, glycidyl or dimethylaminoalkyl, and (c) from 0.1 to 10% by weight of one or a mixture of two or more compounds having the formula

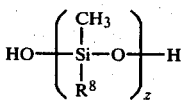

wherein $R^8$ is $C_{1-4}$ alkyl or phenyl; and z is 2 to 25.

2. A photosensitive material according to claim 1 wherein the component (a) is at least one substrate selected from the group consisting of methyltrimethoxy silane, vinyltriethoxy silane, γ-methacryloxypropyltrimethoxy silane, tetraethoxy silane and vinyltrihydroxyethylmethylether silane.

3. A photosensitive material according to claim 1 wherein the first monomer is γ-methacryloxypropyltrimethoxy silane.

4. A photosensitive material according to claim 1 wherein the second monomer is at least one monomer selected from the group consisting of styrene, vinyl acetate, methyl methacrylate, butyl acrylate, glycidyl methacrylate and acrylic acid.

5. A photosensitive material according to claim 1 wherein the thickness of the transparent protective layer is 5–20 μm.

* * * * *

UNITED STATES PATENT OFFICE

CERTIFICATE OF CORRECTION

Patent No. 4 250 240 Dated February 10, 1981

Inventor(s) Masaru Shimada et al

It is certified that error appears in the above-identified patent and that said Letters Patent are hereby corrected as shown below:

Column 10, line 49; change "substrate" to ---substance---.

Signed and Sealed this

Fifth Day of May 1981

[SEAL]

Attest:

RENE D. TEGTMEYER

Attesting Officer

Acting Commissioner of Patents and Trademarks